US006161791A

United States Patent [19]

Gentry, Jr.

[11] Patent Number: 6,161,791

[45] Date of Patent: Dec. 19, 2000

[54] HORIZONTALLY AND VERTICALLY ADJUSTABLE WINDING POST

[76] Inventor: William J. Gentry, Jr., 1657 Oak View Loop Rd., Yanceyville, N.C. 27379

[21] Appl. No.: 09/344,981

[22] Filed: Jun. 25, 1999

Related U.S. Application Data

[60] Provisional application No. 60/131,317, Apr. 27, 1999.

[51] Int. Cl.[7] ..... B65H 19/22; B65H 18/10

[52] U.S. Cl. ..... 242/533.8; 242/545

[58] Field of Search ..... 242/533.8, 533, 242/538, 545, 540

[56] References Cited

U.S. PATENT DOCUMENTS

| | | | |
|---|---|---|---|
| 1,957,518 | 5/1934 | Woock | 242/538 X |
| 2,635,822 | 4/1953 | Burman, Jr. | 242/538 |
| 3,012,735 | 12/1961 | Nebout | 242/538 X |
| 3,796,389 | 3/1974 | Nishiyori et al. | 242/545 X |
| 3,921,926 | 11/1975 | Jores et al. | 242/545.1 X |
| 4,307,851 | 12/1981 | Dunaevsky et al. | 242/545.1 X |
| 4,682,929 | 7/1987 | Kataoka | 242/533.8 X |
| 5,435,501 | 7/1995 | Alexander, III et al. | 242/533.8 |
| 5,443,226 | 8/1995 | Alexander, III et al. | 242/533.8 |

FOREIGN PATENT DOCUMENTS

| | | | |
|---|---|---|---|
| 361277540 | 12/1986 | Japan | 242/545.1 |
| 2277316 | 10/1994 | United Kingdom | 242/557 |

*Primary Examiner*—John Q. Nguyen
*Attorney, Agent, or Firm*—Jenkens & Gilchrist

[57] ABSTRACT

Self-aligning chucks are provided on a docking station that is adapted to provide rotary motion to shaft-mounted rotatable components carried on a portable truck. The chucks are self-aligning, in both vertical and horizontal directions, with respect to the spatial and rotary positions of the shafts of the truck-mounted components. The truck also includes a mechanism for automatically positioning a portable truck with respect to the post and maintaining the portable truck at a desired position.

13 Claims, 4 Drawing Sheets

HORIZONTALLY AND VERTICALLY ADJUSTABLE WINDING POST

This application claims the benefit under Title 35 United States Code §119(e) of U.S. Provisional Application No. 60/131,317, filed Apr. 27, 1999, and under Title 35, United States Code § 120 of U.S. application Ser. No. 09/218,486 filed Dec. 22, 1998 U.S. Pat. No. 5,941,475.

BACKGROUND OF THE INVENTION

1. Technical Field

This invention relates generally a powered post or station at which a portable truck is positioned for material take-up or supply operations, and more particularly to such a post at which the take-up or supply truck is automatically aligned with the post, and take-up or supply members mounted on the truck are automatically horizontally and vertically aligned with drive elements on the post.

2. History of Related Art

Portable trucks are commonly used in various manufacturing operations for the take-up and subsequent transportation of sheet materials, or the delivery and supply of sheet materials to a processing station. In particular, portable trucks are used in the tire manufacturing industry to take-up sheets of rubber plies from a ply processing station, and winding the ply on a roll with a fabric separator provided from a second roll on the truck. In this application, it has heretofore been necessary to carefully position the truck with respect to a drive post which provides a drive mechanism and a brake arrangement for the respective rolls on the truck. This has required that the truck be manually positioned in appropriate relationship with the post, the wheels of the truck dogged or chocked to prevent movement, and then the shafts of each of the rolls individually aligned with drive couplings, or chucks, provided on the post. Moreover, the rolls are typically carried on square end shafts which separately engage a respective coupling on the post. Thus, the shaft of each of the rolls must be individually aligned with a socket provided in each of the drive couplings. Not only has this procedure been very labor intensive, but has sometimes resulted in injury, such as pinched fingers, muscle strain, etc., to the person connecting the portable truck to the stationery post.

In a copending application, U.S. patent application Ser. No. 09/218,486 filed Dec. 22, 1998 by the inventor of the present invention, titled AUTOMATIC WINDING POST, an automatic winding post is disclosed which addresses many of the above problems, but does not have vertical adjustability. As the wheels on a portable truck wear, and the vertical position of the truck mounted components move to an elevationally lower position. If the wheel wear becomes significant, the elevational position of the truck-mounted roll shafts may not be able to vertically align with the post-mounted chucks.

The present invention is directed to overcoming the problems set forth above. It is desirable to have a post, or station, to which a portable truck can be operatively connected without any alignment effort on the part of a person delivering the hand truck to the powered post. It is also desirable to have such a post that automatically positions the portable truck at a desired position with respect to the post. Furthermore, it is desirable to have such a post that is automatically alignable, both vertically and horizontally, with respect to roller shafts mounted on the truck and has chucks which automatically align themselves with a square-end shaft of the truck rolls.

SUMMARY OF THE INVENTION

In accordance with one aspect of the present invention, a vertically disposed winding post, adapted to receive and rotatably drive a pair of vertically spaced apart rolls mounted on a portable truck, has a lower post disposed at a fixed position and an upper post that is attached to the lower post in adjustable horizontal relationship. The winding post also has a lower section mounted on the lower post in vertically movable relationship with the lower post. A rotatable chuck and a means for controlling rotation of the chuck are also mounted on the lower section. The winding post also includes an upper section that is mounted on the upper post in vertically movable relationship with the upper post. A second rotatable chuck and a means for controlling rotation of the second rotatable chuck are also mounted on the upper section of the winding post. Both the upper and lower sections of the winding post have a means for biasing the respective sections toward preselected vertical positions. The winding post also includes a means for drawing the portable truck toward the lower section and maintaining the truck in a fixed spatial relationship with the lower section during rotation of the first and second chucks of the winding post.

Other features of the winding post embodying the present invention include the lower post being fixedly secured to a base plate at a lower end of the lower post and the lower section having a lower end fixedly secured to a bottom plate having a plurality of apertures extending through the bottom plate. Moreover, the means for biasing the lower section toward a preselected vertical position includes a plurality of pins, each having a first end attached to the base plate of the lower post, a second end spaced from the first end, a threaded end portion adjacent the second end, a mid portion adapted to be slidably received through a corresponding one of the apertures in the bottom plate of the lower section, an adjusting nut threadably mounted on the threaded second end portion, and a first spring disposed about the pin at a position between the base plate of the lower post and the bottom plate of the lower section.

Still other features include the upper post of the winding post embodying the present invention having a lower end fixedly secured to a base plate, and the upper section of the winding post having a lower end fixedly secured to a bottom plate that has a plurality of apertures extending therethrough. The means for biasing the upper section toward a preselected vertical position includes a plurality of pairs of springs, one member of the pair being mounted on each side of the bottom plate of the upper section, the lower spring being positioned between the bottom plate and the base plate, and the upper spring being positioned between the bottom plate and a washer positioned adjacent an adjusting nut at an upper, or second end of a pin. The first end of each of the pins is secured to the base plate of the upper post. Each pin is enclosed by one of the pairs of pins and has a mid-portion that is slidably received in one of the apertures through the bottom plate of the upper section. The vertical position of the upper section is selectively adjusted by turning respective adjusting nuts located on threaded end portions of the pins, whereby the length of the respective springs are either shortened or lengthened and the bottom plate of the upper section accordingly raised or lowered as desired. Thus, the respective lower and upper sections are biased toward the preselected vertical position, but are capable of vertical movement against the respective biasing forces.

Still other features of the winding post embodying the present invention include the upper post being horizontally adjusted in a lateral direction with respect to a longitudinal axis of the upper roll of the portable truck in response to drawing the truck toward the lower section by the means for drawing the truck toward the lower section and maintaining the truck in fixed spatial relationship with the lower section. More specifically, the means for drawing the truck toward the lower section and maintaining the truck in a fixed spatial relationship with the lower section includes at least one locking arm slidably mounted on the lower section of the winding post. The locking arm has a distal end adapted to engage a predefined feature of the truck and is selectively movable in a substantially horizontal direction toward and away from the lower section. The locking arm has a proximal end spaced from the distal end. An extendable cylinder or, if desired, a pair of cylinders, has a first end connected to the lower section of the winding post and a second end connected to the proximal end of the locking arm whereby the distal end of the locking arm is selectively moved toward and away from the lower section in response to respectively extending and retracting the extendable cylinder or pair of cylinders. Furthermore, an adjustable stop mounted on the lower section is positioned to abut a predetermined feature of the truck when the locking arm draws the truck toward the lower section and the truck is spaced at a preselected distance from the lower section.

Yet other features of the winding post embodying the present invention include means for controlling the rotation of the rotatable chucks. The means for controlling the rotation of the first rotatable chuck being an air brake, and the means for controlling the rotation of the second rotatable chuck being a right angle gear operatively connected to the second chuck and a motor operatively connected to the right angle gear.

Still another feature of the winding post embodying the present invention includes each of the jaws of the first and second rotatable chucks having an arm pivotably mounted to a body portion of the respective chuck, and a workpiece-contacting head pivotably mounted on a distal end of the arm.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION OF A PRESENTLY PREFERRED EXEMPLARY EMBODIMENT

Figure 1:
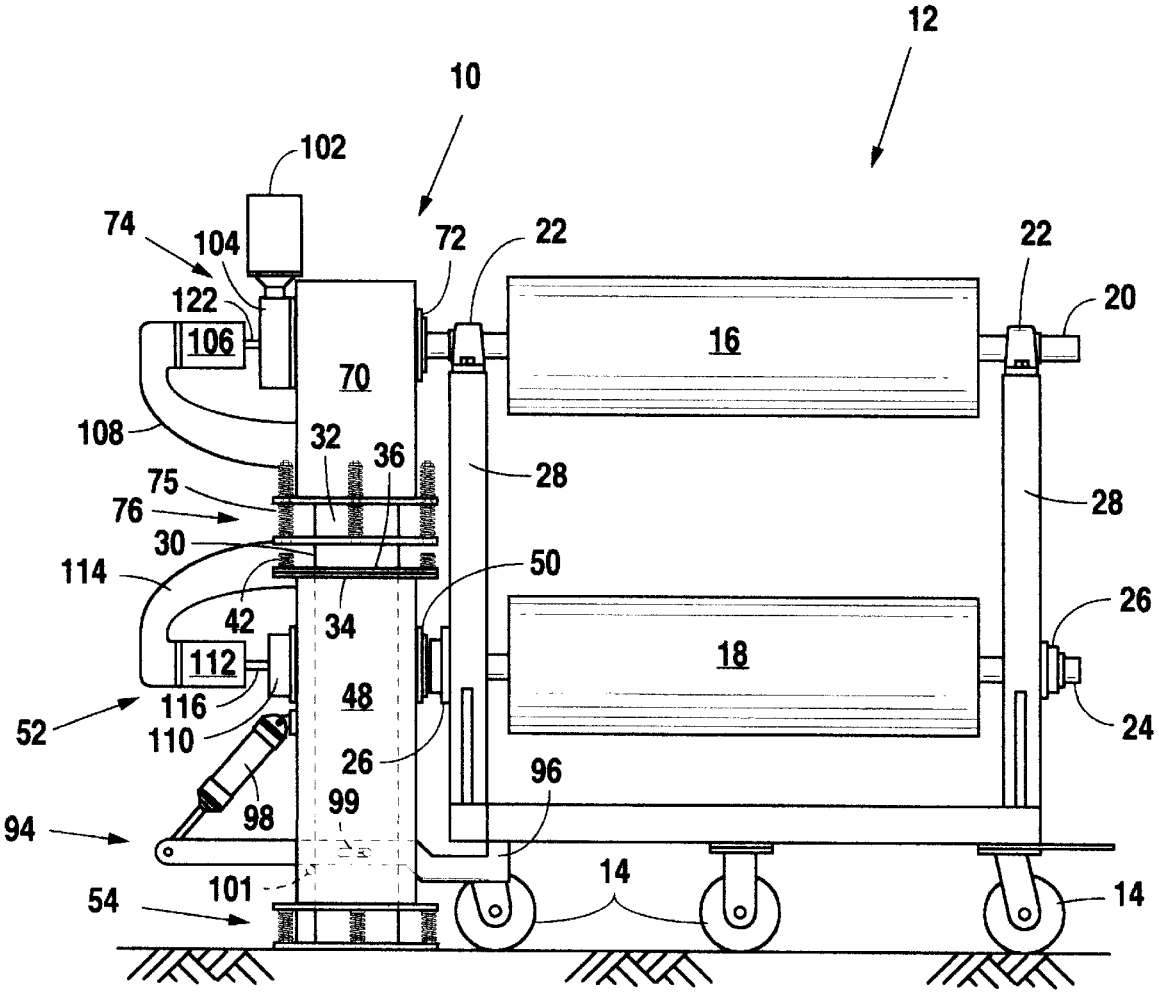
FIG. 1 is a side elevational view of the winding post embodying the present invention, showing a portable truck operationally connected to the winding post.

In an illustrative preferred embodiment of the present invention, as shown in FIG. 1, an automatic winding post 10 is arranged to receive and operate take-up and interleaf separator feed rolls on a portable truck 12 used in tire manufacturing operations. In the illustrated embodiment, the automatic winding post 10 is adapted to receive the portable truck 12 mounted on a plurality of wheels or castors 14 which facilitate movement of the truck 12 between processing stations. The winding post 10 also rotates, or controls the rotation of, supply and take-up rolls carried on the truck. More specifically, an upper roll 16 and a lower roll 18 are rotatably mounted on the truck 12. The upper roll 16 is mounted on a square-ended shaft 20 rotatably supported in a pair of pillow blocks 22, and the lower roll 18 is mounted on a square-ended shaft 24 rotatably supported in a pair of flange bearings 26, all disposed on a pair of vertical support members 28 attached to the base of the portable truck 12.

In the illustrated embodiment, the upper roll 16 is adapted to take-up a sheet, or ply of rubber from a ply processing station, and the lower roll 18 is adapted to provide a supply of fabric which serves as an interleaf or separator between adjacent layers of the sheet ply wound on the top roll 16. If desired, the functional operation of the upper and lower rolls may be reversed, or adapted for other uses.

Figure 2:
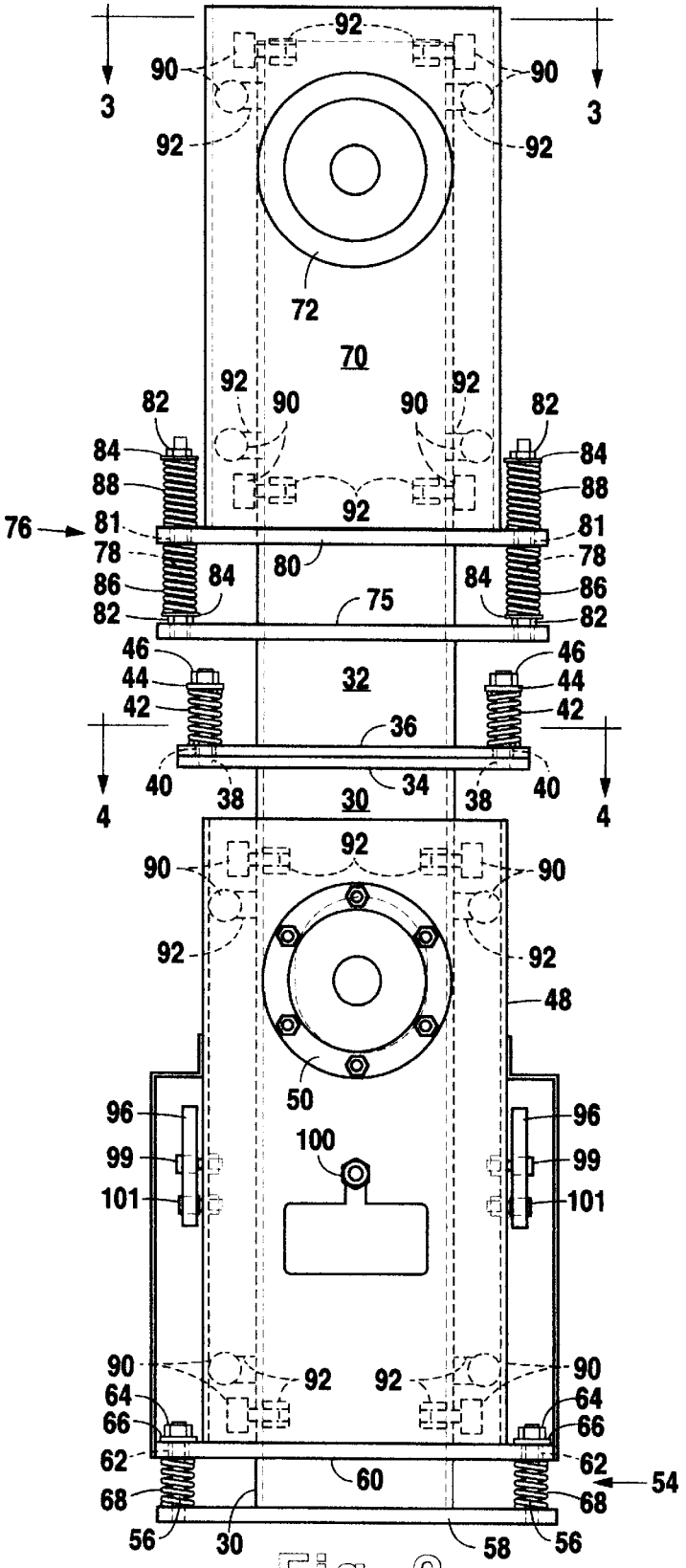
FIG. 2 is a front elevational view of the winding post embodying the present invention.

In the illustrated preferred embodiment, as best shown in FIGS. 1 and 2, the winding post 10 has two separate posts, a lower post 30 that is anchored to a floor at a pre-designated position, and an upper post 32 that, as described below in greater detail, has limited lateral movement capability with respect to the lower post 30. In an illustrative example, the upper and lower posts 30, 32 of the automatic winding post 10 are formed of 8"×8" steel tubing.

Figure 4:
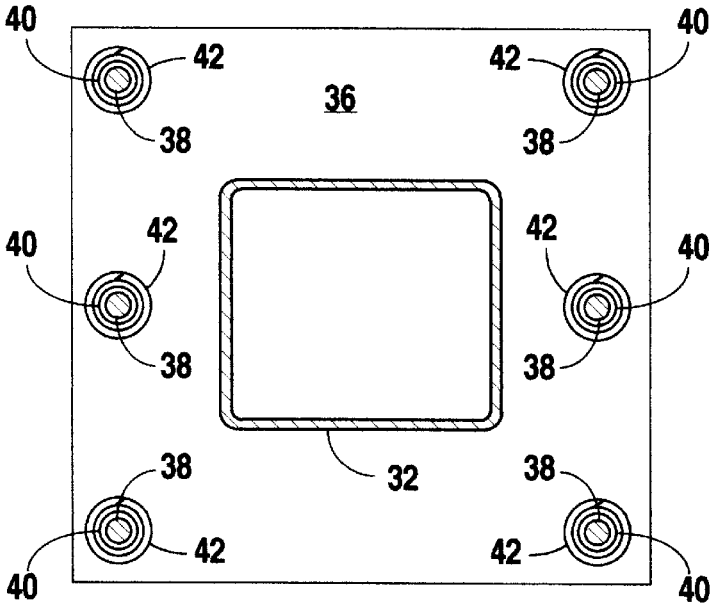
FIG. 4 is a sectional view of the winding post embodying the present invention, taken together along the line 4—4 of FIG. 2.

The upper post 32 of the winding post 10 is laterally moveable, in a somewhat restricted fashion, with respect to the lower post 30. In the illustrated embodiment, a top plate, or flange, 34 extends beyond the sidewalls of the lower post 30, e.g., a 12"×14" rectangular plate or a similarly-sized perimeter flange, is welded to the upper end of the lower post 30. In similar fashion, a base plate, or second flange, 36 that extends beyond the sidewalls of the upper post 32, and desirably having the same size and shape as the top plate 34 of the lower post 30, is welded to the bottom of the upper post 32. With added reference to FIG. 4, a plurality of dowel pins 38 are attached to the top plate 34 attached to the lower post 30 and extend through enlarged openings, or laterally oriented slots, 40 provided in the base plate 36 attached to the lower end of the upper post 32. A spring 42 is mounted on each of the dowel pins 38 above the base plate 36, and is maintained in biased contact with the base plate 36 by a washer 44 and a nut 46 that is adjustably threaded onto the upper end of the dowel pin 38. Thus, the top plate 34 attached to the lower post 30 of the winding post 10 and the base plate 36 attached to the lower end of the upper post 32, are maintained in biased contact with each other by the force of the springs 42, but are free to move laterally within the limits of the enlarged openings, or slots, 40 provided in the base plate 36.

The winding post 10 embodying the present invention also includes two "floating" sections that can independently move in biased vertical directions to accommodate vertical misalignment of the shafts 20, 24 about which the upper roll 16 and lower roll 18 respectively rotate. For example, when the wheels 14 of the truck 12 become worn, the upper and lower rolls 16, 18 will be positioned closer to the floor than when the wheels are new. To accommodate such changes in the vertical position of the upper roll 16 and lower roll 18, the winding post 10 includes a lower section 48 mounted on the lower post 30 in vertically movable relationship with the lower post 30. The lower section 48 has a first rotatable chuck 50 mounted thereon and a first means 52 for controlling the rotation of the first rotatable chuck 50.

Importantly, the winding post 10 also includes a second means 54 for biasing the lower section 48 toward a preselected vertical position. The second means 54 includes a plurality of first pins 56, each of which has a first end attached to a base plate 58 secured to the lower end of the lower post 30, and by which the lower post 30 is anchored to the floor, and a second end spaced from the first end of the pin 56. Each of the pins 56 also include a threaded end portion adjacent the second end. The lower section 48 has a lower end fixedly secured to a bottom plate, or flange, 60 which has a plurality of apertures 62 extending through the bottom plate 60. Each of the first pins 56 is adapted to be slidably received through a corresponding one of the apertures 62 in the bottom plate 60 of the lower section 48. The second means 54 for biasing the lower section 48 to a preselected vertical position also includes an adjusting nut 64 threadably mounted on the threaded second end portion of the first pins 56, a washer 66 disposed adjacent each of the adjusting nuts 64 at a position inwardly from the end of the pins 56, and a first spring 68 disposed about each of the pins 56 at a position between the bottom plate 60 of the lower section 48 and the base plate 58 of the lower post 30.

The winding post 10 also includes an upper section 70 mounted on the upper post 32 in vertically movable relationship with the upper post 32. A second rotatable chuck 72 is mounted on the upper section 70 which also has a third means 74 for controlling the rotation of the second rotatable chuck 72. A flange 75 extends around the perimeter of the upper post 32, and is secured directly to the upper post 32 at a position near the lower end of the upper post 32 but spaced above the base plate 36 of the upper post 32 to allow clearance for the springs 42 and access to the bias force adjusting nuts 46.

The winding post 10 also includes a fourth means 76 for biasing the upper section 70 toward a preselected vertical position. The fourth means 76 includes a plurality of second pins 78, each of which has a first end attached to the base plate 36 secured to the lower end of the upper post 32, and a second end spaced from the first end of the second pins 78. Each of the second pins 78 also has threaded end portions adjacent each of the first and second ends. The upper section 70 has a lower end fixedly secured to a bottom plate, or flange, 80 which has a plurality of apertures 81 extending through the bottom plate 80. Each of the second pins 78 has a mid portion adapted to be slidably received through a corresponding one of the apertures 81 in the bottom plate 80 of the upper section 70. The fourth means 76 for biasing the upper section 70 toward a preselected vertical position also includes an adjusting nut 82 threadably mounted on each of the threaded end portions of the second pins 78, a washer 84 disposed adjacent each of the adjusting nuts 82 at a position inwardly from the respective ends of the pins 78, second springs 86 disposed about each of the second pins 78 at a position between the washer 84 disposed adjacent the adjusting nut 82 mounted on the threaded first end portion of the pin 78 and the bottom plate 80 of the upper section 70, and third springs 88 disposed about the second pins 78 at a position between the washer 84 positioned adjacent the adjusting nut 82 mounted on the threaded second end portion of the pins 84 and the bottom plate 80 of the upper section 70.

Figure 3:
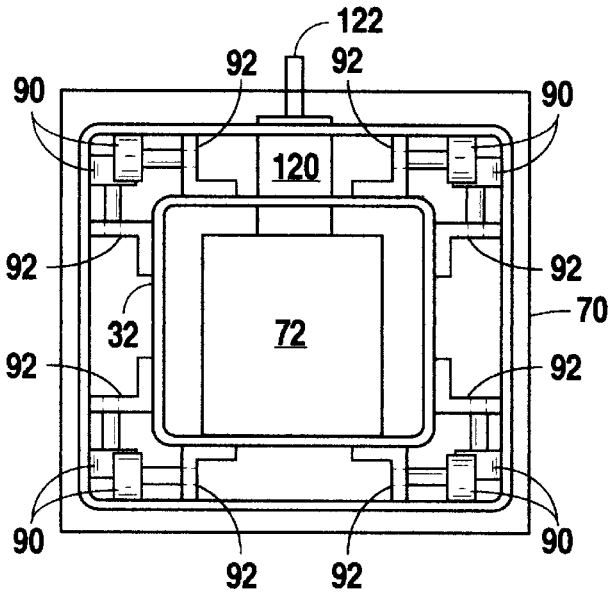
FIG. 3 is a sectional view of the winding post embodying the present invention, taken along the line 3—3 of FIG. 2.

The upper section 70 and lower section 48 are independently vertically movable with respect to their respective upper post 32 and lower post 30. Each of the sections 70, 48 are desirably formed of steel tubing, for example, 12"×12", that has an inside diameter greater than the outside diameter of the associated posts 32, 30. As shown in FIGS. 2 and 3, alignment between the sections 70, 48 and the posts 32, 30 during vertical movement is maintained by a plurality of rollers 90 that are mounted on flanges 92 attached to the posts 32, 30. Desirably, there is a set of four rollers positioned near the top and bottom of each of the respective sections 70, 48 when the sections 70, 48 are positioned at a desired proximate operational vertical distance from the floor. The rollers 90 tightly abut the inside surface of the respective sections 70, 48 and not only provide rolling contact between the respective sections 70, 48 and the posts 32, 30, but also resist twisting of the sections 70, 48 with respect to the posts 32, 30.

The lower section 48 of the winding post 10 also includes a fifth means 94 for drawing the truck 12 toward the lower section 48 and maintaining the truck 12 in fixed relationship with respect to the lower section 48. More specifically, the fifth means 94 includes at least one, and preferably two, horizontally moveable locking arms 96, as shown in FIGS. 1 and 2, that are reciprocable in a horizontal direction. Each of the arms 96 has a distal end adapted to engage a predetermined feature of the truck 12, such as a cross-member support for the wheels 14. The locking arms 96 also have an opposite, or proximal, end that is pivotally attached to an extendable cylinder 98. A central portion of the locking arms 96 has a slot adapted to receive a cam follower 99 attached to the lower section 48 of the automatic winding post 10. Second cam followers 101 are attached to the lower section 48 at a point whereat they abut a lower edge of the locking arms 96. When positioning the truck 12 at the automatic winding post 10, the moveable end of the cylinder 98 is retracted to extend the distal end of the locking arms 96 to a position spaced from the lower section 48 of the post 10. The truck 12 is placed in an approximately aligned position with respect to the winding post 10, whereat the extended distal end of the locking arms 96 engage the supporting structure or other predefined feature of the truck 12. The locking arms 96 are then retracted, drawing the truck 12 toward the lower section 48 in response to extending the moveable end of the cylinder 98, until the truck 12 is brought into contact with an adjustable stop 100 mounted on the lower section 48. The truck 12 is, thereby, generally laterally aligned with the lower section 48 of the lower section 48, is spaced at a predetermined position from the lower section 48, and is maintained at that aligned and spaced position during material take-up or other operations.

A motor 102 is connected to a right angle gear box 104 which is mounted on the upper section 70 of the winding post 10 to provide rotation of the second rotatable chuck 72. An extendable air cylinder 106 is mounted on an arm 108 attached to the upper section 70 of the winding post 10 and provides reciprocal motion to a shaft 110 to operate the second chuck 72 mounted in the upper section 70, as described below in greater detail. An air brake 110 is mounted on the lower section 48 of the automatic winding post 10 to provide controllable resistance to rotation of the lower roll 18, and assure tension in the fabric interleaf as it is drawn between the plies of the upper roll 16. Another air cylinder 112 is mounted on an arm 114 attached to the lower section 48 of the post 10 and provides reciprocal motion to an actuating shaft 116 to open and close the jaws of the first chuck 50 mounted in the lower section 48.

Figure 5:
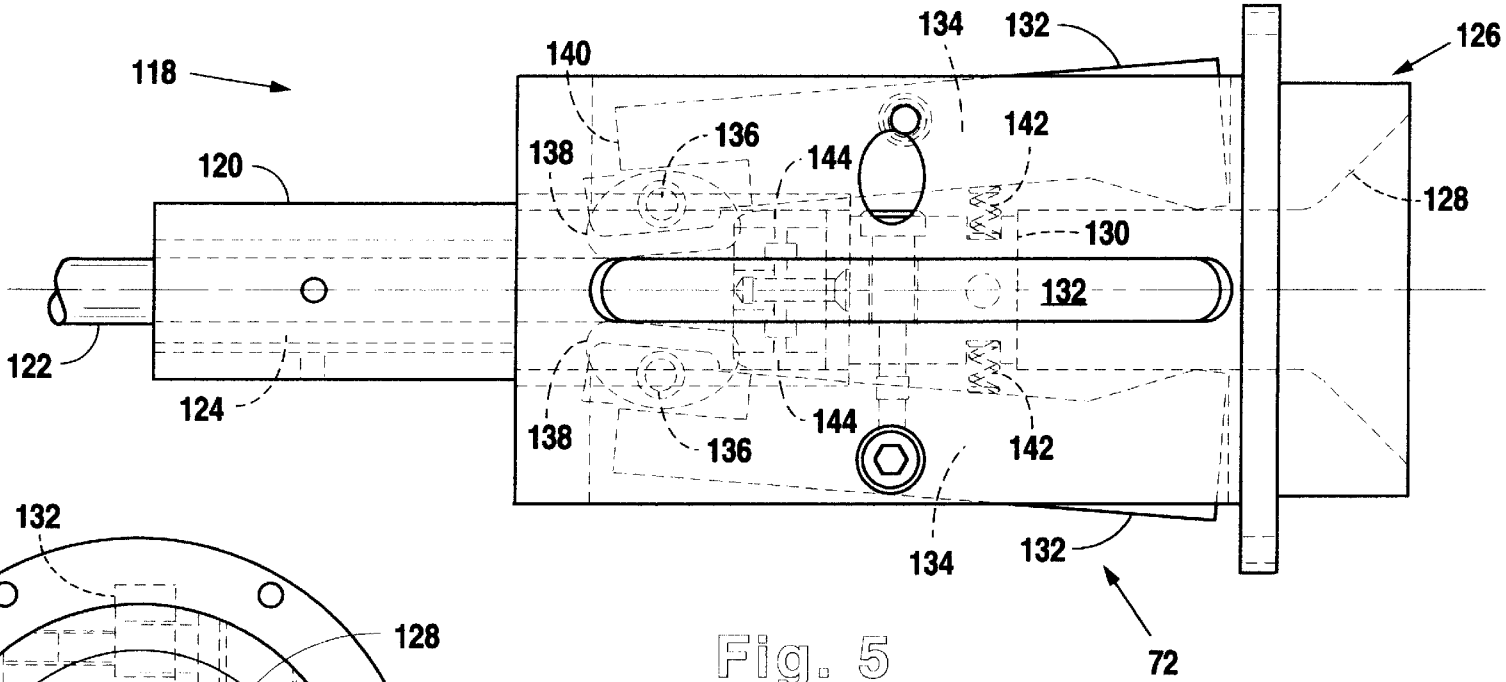
FIG. 5 is an elevational view of the automatically aligning four-jaw chuck embodying another aspect of the present invention.
Figure 6:
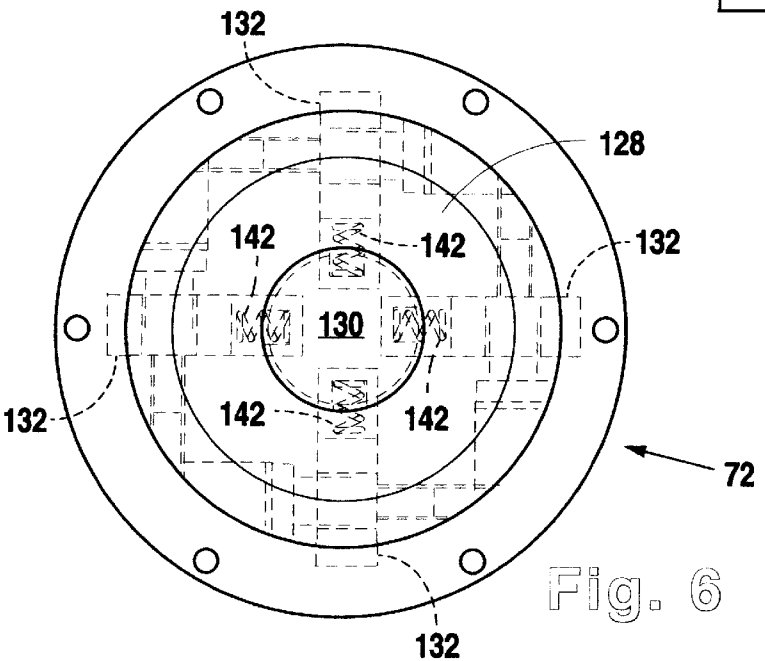
FIG. 6 is a drive attachment end view of the four-jaw chuck shown in FIG. 5.

Turning now to FIGS. 5 and 6, the first chuck 50 and the second chuck 72 are substantially identical four-jaw chucks respectively mounted in the lower and upper sections 48,50 of the post 10. The following description of the substantially identical chucks will, for the sake of simplicity, refer to the upper rotatable chuck 72 with the understanding that the description is equally applicable to the lower chuck 50. The chuck 72, as illustrated in FIGS. 5 and 6, has a proximal end 118 with an outwardly extending portion 120 adapted for connection, respectively, to the right angle gear box 104 or, for the lower chuck 48, to the air brake 110. The respective actuating shafts 116, 122, attached to the air cylinders 112, 106 are carried within the outwardly extending portion 120 of the chucks 72, 50, in rotatable relationship with the chucks 72, 50, by a bushing 124 positioned around the actuating shaft 116, 122.

A distal end 126 of the chucks 72, 50 has a conically-shaped opening 128, diverging inwardly from the open distal end 126, to provide a guide for the square end of the shaft 20 supporting the upper roll 16 or, alternatively, the square end of the shaft 24 which supports the lower roll 18. As the truck 12 is drawn toward the post 10 by the locking arms 96, the square end of the shaft 20 supporting the upper roll 16 engages the conical surface 128 at the open distal end 126 of the chuck 72 and incrementally moves the upper section 70 of the post 10, which is biasedly movable both vertically and horizontally, to bring the chuck 72 into alignment with the shaft 20. The square end of the shaft 20 is drawn into the chuck 72 to a position whereat the end of the shaft 20 is seated adjacent a bottom 130 of the opening 128.

The first chuck 50 mounted in the lower section 48 of the post 10 is similarly vertically positioned to receive the square end of the shaft 24 supporting the lower roll 18. When the truck 12 is drawn toward the post 10 by extension of the moveable end of the cylinder 98 attached to the end of the locking arms 96, the upper roll shaft 20 and the lower roll shaft 24 are drawn into the respective openings 128 at the distal end 126 of the chucks 50, 72. Since the upper section 70 of the post 10 is laterally moveable with respect to the lower section 48, contact of the shafts 20, 24 with the respective conical openings 128 of the chucks 50, 72, urges the chucks 50, 72 into respective alignment with the shaft ends.

Figure 7:
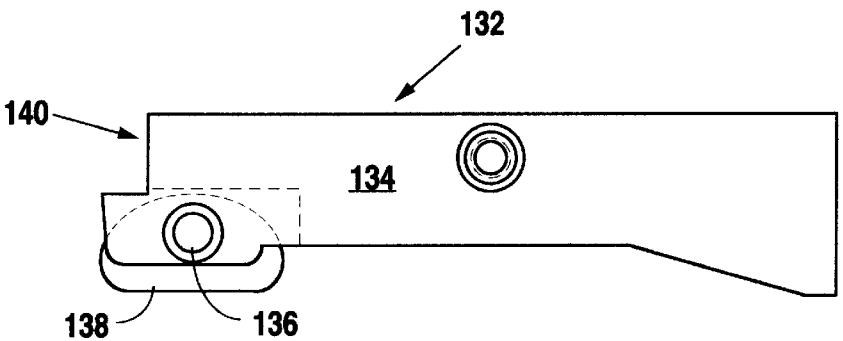
FIG. 7 is an elevational view of one of the jaws of the four-jaw chuck shown in FIG. 5.

Each of the chucks 50, 72 have four jaws 132, as best shown in FIG. 7, formed by an arm 134 that is pivotally mounted to the body of the respective chuck 50 by a respective pin 136, and an anvil contacting head 138 pivotally mounted on a proximal end 140 of the arm 134. The pivotally mounted anvil contacting heads 138 provide for movement of the arms 134 during rotation of the chucks 50, 72 to accommodate bent or otherwise damaged shaft ends which do not rotate about a true axis aligned with the rotational axis of the chucks 50, 72. The arms 134 are biased toward an open position, as indicated by the dotted outline of the jaws in FIG. 4, by a respective spring 142.

When the shafts 20, 24 are fully seated within the respective openings 128, the air cylinders 112, 106 move the actuating shafts 122, 116 to retract their respective ends. Each of the chucks 50, 72 have a bearing-mounted anvil, or plunger, 144 attached to the respective end of the actuating shaft 122, 116 of the air cylinders 112, 106, so that the anvil is able to rotate with respect to the actuating shaft 122, 116. As the anvil 142 is drawn toward the proximal end 118 of the chuck 72, by actuation of the air cylinder 106, the anvil bears against the pivotally mounted anvil contacting head 138 of each of the jaws 132 and forces each of the jaws 132 to pivot about the respective pin 136. The opposite, or clamping, end of the jaws 132, are thus moved radially inwardly so that the gripping surface of each jaw head comes into forced abutment with a planar surface of the respective square shaft 20, 24 and, if necessary incrementally rotates the rolls 16, 18 to align the shaft ends with the jaws 132. Thus, each of the shafts 20, 24 are automatically aligned with a gripping surface within the chuck 72.

After completion of rolled material pay-out, take-up, or other operation, the respective shafts 122, 116 of the air cylinders 106, 112, are extended and the respective jaws 132 of the chucks 72 moved to a position away from contact with the respective square shaft ends 20, 24 of the upper roll 16 and the lower roll 18 by the springs 142. Simultaneously, or immediately thereafter, the locking arm 96 is extended, and the truck 12 moved away from the post 10 and delivered to a subsequent processing station.

Thus, it can be readily seen that the automatic winding post 10, may be used as a docking post or station in many applications. The post 10 not only provides for positioning of a portable truck with respect to the post 10, but the chucks 50, 72 are also alignable with driven components rotatably carried on the truck 12. Also, it can be readily seen that the chucks 50, 72, having four jaws each of which is adapted to forcibly and alignably abut a respective flat surface of the end portion of a square shaft, is also self-aligning with respect to the flat surface of the shaft. Also, the upper and lower chucks 50, 72, and their respective motor-driven gear box 104 or air brake 110, may be reversed one for the other, or other drive or brake arrangements substituted for those illustrated herein. These important characteristics and capabilities of the present invention significantly decrease the amount of difficult manual effort heretofore required to position and align a truck, by shimming or blocking, with respect to a drive post.

Although the present invention is described in terms of a preferred exemplary embodiment, with specific key arrangements of bias structures, chucks, and locking arms, those skilled in the art will recognize that changes in the arrangement of exemplary bias structures, chucks and locking arms may be made without departing from the spirit of the invention. For example, other spring arrangements providing biased vertically selective positioning of the "floating" sections with respect to the fixed support posts may be implemented in carrying out the present invention. Such changes are intended to fall within the scope of the following claims. Other aspects, features, and advantages of the present invention may be obtained from a study of the disclosure and the drawings, along with the appended claims.

ELEMENT LIST

10 winding post
12 truck
14 wheels (of 12)
16 upper roll (of 12)
18 lower roll (of 12)
20 square end shaft (of 16)
22 pillow block (of 16)
24 square end shaft (of 18)
26 flange bearings (of 18)
28 vertical support members (of 12)
30 lower post
32 upper post
34 top plate (of 30)
36 base plate (of 32)
38 dowel pins
40 slots (in 36)
42 spring (around 38)
44 washer (at top of 38)
46 nut (at top of 38)

48 lower section
50 first rotatable chuck
52 first means (for controlling rotating of 50)
54 second means (for biasing 48)
56 first pins (of 54)
58 base plate (of 30)
60 bottom plate (of 48)
62 apertures (through 60)
64 adjusting nut (of 54)
66 washer (of 54)
68 first spring (of 54)
70 upper section
72 second rotatable chuck
75 perimeter flange (around 32)
74 third means (for rotating 72)
76 fourth means (for biasing 70)
78 second pins (of 76)
80 bottom plate (of 70)
81 apertures (through 80)
82 adjusting nuts (of 76)
84 washer (of 76)
86 second spring (of 76)
88 third spring (of 76)
90 rollers
92 flanges
94 fifth means (for drawing 12 toward 48)
96 locking arms
98 cylinder (on 48 to operate 96)
99 cam follower
100 adjustable stop
101 cam follower
102 motor
104 right angle gear box
106 air cylinder (on 70)
108 arm (on 70)
110 air brake
112 air cylinder (on 48)
114 arm (on 48)
116 actuating shaft (for 50)
118 proximal end (of 72)
120 outward extending portion (of 118)
122 actuating shaft (for 72)
124 bushing (in 72)
126 distal end (of 72)
128 conically shaped opening (at 126)
130 bottom (of 128)
132 jaws (ofchuck72)
134 arm (of 132)
136 pin
138 anvil-contacting head (of 132)
140 proximal end (of 134)
142 spring (of 72)
144 anvil (of 72)

What I claim is:

1. A vertically disposed winding post for receiving and rotatably operating lower and upper vertically spaced rolls mounted on a portable truck, said winding post comprising:

a lower post disposed at a fixed predetermined position;

a lower section mounted on said lower post in vertically movable relationship with the lower post, said lower section having a first rotatable chuck mounted thereon and a first means for controlling the rotation of said first rotatable chuck;

a second means for biasing said lower section toward a preselected vertical position;

an upper post attached to said lower post in adjustable horizontal relationship with said lower post;

an upper section mounted on said upper post in vertically movable relationship with the upper post, said upper section having a second rotatable chuck mounted thereon and a third means for controlling the rotation of said second rotatable chuck;

a fourth means for biasing said upper section toward a preselected vertical position; and a fifth means for drawing said truck toward said lower section and maintaining the truck in a fixed spatial relationship with the lower section during rotation of said first and said second chucks.

2. A winding post, as set forth in claim 1, wherein:

said lower post has a lower end fixedly secured to a base plate;

said lower section has a lower end fixedly secured to a bottom plate having a plurality of apertures extending therethrough; and said second means for biasing said lower section toward a preselected vertical position includes a plurality of first pins each having a first end attached to the base plate of the lower post, a second end spaced from the first end, a threaded end portion adjacent the second end, a mid portion adapted to be slidably received through a corresponding one of said apertures in the bottom plate of the lower section, an adjusting nut threadably mounted on the threaded end portion, and a first spring disposed about the pin at a position between the base plate of the lower post and the bottom plate of the lower section.

3. A winding post, as set forth in claim 1, wherein:

said upper post has a flange extending around the perimeter of the upper post at a position proximate a lower end of a base plate;

said upper section has a lower end fixedly secured to a bottom plate having a plurality of apertures extending therethrough; and said fourth means for biasing said upper section toward a preselected vertical position includes a plurality of second pins each having a first end attached to the perimeter flange of the upper post, a second end spaced from the first end, threaded end portions adjacent each of the first and second ends, a mid portion adapted to be slidably received through predetermined ones of said apertures in the bottom plate of the upper section, an adjusting nut threadably mounted on each of the threaded end portions, a washer disposed adjacent each of the adjusting nuts at a position inwardly from the respective end of the pin, a second spring disposed about the pin at a position between the washer disposed adjacent the adjusting nut mounted on the threaded first end portion of the pin and the bottom plate of the upper section, and a third spring disposed about the pin at a position between the washer positioned adjacent the adjusting nut mounted on the threaded second end portion of the pin and the bottom plate of the upper section.

4. A winding post, as set forth in claim 1, wherein said upper post is horizontally adjusted in a lateral direction with respect to a longitudinal axis of the upper roll of said portable truck in response to drawing said truck toward said lower section by said fifth means and inserting a shaft end of said upper roll into said second rotatable chuck.

5. A winding post, as set forth in claim 1, wherein said fifth means for drawing said truck toward said lower section and maintaining the truck in a fixed spatial relationship with the lower section during rotation of said first and said second chucks includes:

at least one locking arm slidably mounted on said lower section of the winding post and having a distal end adapted to engage a predefined feature of said truck and is selectively movable in a substantially horizontal direction toward and away from said lower section, and a proximal end spaced from said distal end;

an extendable cylinder having a first end connected to said lower section of the winding post and a second end connected to said proximal end of the locking arm whereby said distal end of the locking arm is selectively moved toward and away from said lower section in response to respectively extending and retracting said extendable cylinder; and an adjustable stop mounted on said lower section, said adjustable stop being positioned to abut a predetermined feature of said truck when said locking arm draws said truck toward said lower section and said truck is spaced at a preselected distance from said lower section.

6. A winding post, as set forth in claim 1, wherein said first means for controlling the rotation of said first rotatable chuck includes an air brake operatively connected to said first rotatable chuck.

7. A winding post, as set forth in claim 1, wherein said third means for controlling the rotation of said second rotatable chuck includes a right angle gear operatively connected to said second chuck and a motor operatively connected to said right angle gear.

8. A winding post, as set forth in claim 1, wherein said lower post has a flange mounted on an upper end thereof, said upper post has a base plate attached to a lower end of the upper post with a plurality of enlarged openings extending through the base plate, and said winding post includes a plurality of biased dowel pins that cooperatively maintain the flange of the lower post and the base plate of the upper post in biased, laterally slidable contact with each other.

9. A winding post, as set forth in claim 1, wherein said first rotatable chuck has four jaws and an actuating shaft connected to said first chuck which operatively moves said jaws between open and closed positions in response to respectively extending and retracting said actuating shaft, and said winding post includes an extendible cylinder attached to the lower section of said winding post and having a movable end attached to said actuating shaft connected to the first chuck.

10. A winding post, as set forth in claim 9, wherein each of the jaws of said first rotatable chuck comprises an arm pivotally mounted to a body portion of the chuck and an anvil-contacting head pivotally mounted on a proximal end of said arm.

11. A winding post, as set forth in claim 1, wherein said second rotatable chuck has four jaws and an actuating shaft connected to said second chuck which operatively moves said jaws between open and closed positions in response to respectively extending and retracting said actuating shaft, and said winding post includes an extendible cylinder attached to the upper section of said winding post and having a movable end attached to said actuating shaft connected to the second chuck.

12. A winding post, as set forth in claim 11, wherein each of the jaws of said second rotatable chuck comprises an arm pivotally mounted to a body portion of the chuck and an anvil-contacting head pivotally mounted on a proximal end of said arm.

13. A winding post, as set forth in claim 1, wherein the lower and upper posts respectively have a plurality of rollers mounted externally of the respective post and which rotatably engage an inner surface of the lower and upper section respectively mounted on the lower and upper post.

* * * * *

UNITED STATES PATENT AND TRADEMARK OFFICE

CERTIFICATE OF CORRECTION

PATENT NO. : 6,161,791

DATED : December 19, 2000

INVENTOR(S) : Gentry, Jr.

It is certified that error appears in the above-indentified patent and that said Letters Patent is hereby corrected as shown below:

Title page,
Item [60]

Insert --This application is a continuation of U.S. application Ser. No. 09/218,486 filed Dec. 22, 1998, now U.S. Patent No. 5,941,475.--

Signed and Sealed this

First Day of May, 2001

Nicholas P. Godici

*Attest:*

NICHOLAS P. GODICI

*Attesting Officer*

*Acting Director of the United States Patent and Trademark Office*